US006973808B2

(12) United States Patent
Peska

(10) Patent No.: US 6,973,808 B2
(45) Date of Patent: Dec. 13, 2005

(54) APPARATUS AND METHOD FOR WASHING OF ITEMS

(75) Inventor: Lawrence Peska, Garnerville, NY (US)

(73) Assignee: General Product International, Ltd., Monsey, NY (US)

( * ) Notice: Subject to any disclaimer, the term of this patent is extended or adjusted under 35 U.S.C. 154(b) by 16 days.

(21) Appl. No.: 10/644,303

(22) Filed: Aug. 20, 2003

(65) Prior Publication Data

US 2004/0034943 A1 Feb. 26, 2004

Related U.S. Application Data

(60) Provisional application No. 60/404,584, filed on Aug. 20, 2002.

(51) Int. Cl.[7] ..... B65D 33/01
(52) U.S. Cl. ..... 68/235 R; 383/103
(58) Field of Search ..... 68/213, 235 R; 223/84, 66; 383/66, 95, 97, 100, 103

(56) References Cited

U.S. PATENT DOCUMENTS 4,974,967 A * 12/1990 Tsuyoshi et al. ..... 383/97
5,320,429 A * 6/1994 Toyosawa ..... 383/117
5,556,013 A * 9/1996 Mayer ..... 223/84
5,829,083 A * 11/1998 Sutton ..... 8/150
5,964,533 A * 10/1999 Ziglar ..... 383/36
5,971,236 A * 10/1999 DesForges et al. ..... 223/84
6,234,368 B1 * 5/2001 DesForges et al. ..... 223/84
6,536,952 B1 * 3/2003 Hsieh ..... 383/117
6,742,683 B1 * 6/2004 Phan ..... 223/84

* cited by examiner

*Primary Examiner*—Joseph L Perrin
(74) *Attorney, Agent, or Firm*—David Aker

(57) ABSTRACT

An apparatus for washing at least one item, comprising a frame having a dome shape when viewed from its end, and a generally semicircular shape when viewed from its side; and a flow through mesh on the frame which allows washing fluid (generally water) to freely flow to and from the item being washed; the apparatus having an opening through which the at least one item to be washed can be placed into and removed from the apparatus. The frame may have an endless pocket; and a stiffener disposed within the pocket, the stiffener having a length exceeding that of the endless pocket, so that ends of the stiffener overlap each other within the pocket. A method for using the apparatus includes folding a brassiere so that the cups nest before it is placed in the apparatus.

25 Claims, 6 Drawing Sheets

APPARATUS AND METHOD FOR WASHING OF ITEMS

This application claims priority under 35 U.S.C. 119(e) from U.S. provisional application Ser. No. 60/404,584 filed on Aug. 20, 2002, which is incorporated by reference herein, in its entirety.

BACKGROUND OF THE INVENTION

1. Field of the Invention

The present invention relates to apparatus used for washing of items that may include personal care and delicate items. More particularly, it relates to apparatus used for washing of items which are readily damaged by washing machines, such as personal care items including prosthetic devices and delicate items such as lingerie generally, and in particular, brassieres.

2. Prior Art

Very delicate garments, such as items of lingerie, including brassieres, panties and other similar items, can be protected from damage by hand washing. However, with the demands of a busy schedule, this not is generally a viable option.

Many washing machines manufactured today have some settings that may be used for more gentle washing cycles. However, these setting may not be adequately gentle to preserve the shape of delicate fabrics and to prevent other types of damage. Further, it is often desirable to run a full load of various fabrics that need cleaning, and even if a gentle wash cycle is used, the mere presence of a full load of other items, during the various washing cycles, may cause damage to delicate items. Finally delicate and generally expensive items such as prosthetic devices, such as, for example, prosthetic brassieres, need to be carefully handled during machine washing to avoid damage.

Thus, there is a need for a way to protect the integrity of items during the machine washing process, which provides flexibility in the use of the washing machine in terms of size of load and selected washing cycles.

SUMMARY OF THE INVENTION

It is an object of the invention to provide a device for protecting items while being washed in a washing machine.

It is a further object of the invention to provide a device that does not interfere with the washing process.

It is a further object of the invention to provide a device that is relatively simple to manufacture and low in cost.

It is yet another object of the invention to provide a method for washing items, and in particular, a brassiere.

These objects and others are achieved in accordance with the invention by an enclosure for items includiing a simple frame and a flow through mesh on the frame that allows washing water to freely flow to and from the item being washed. An opening for the item or items to be washed may be closed by a zipper. A pocket may be provided for the zipper pull so that when in the closed position, the zipper pull is hidden, the zipper will remain closed, and the zipper pull will not damage fabrics outside the enclosure.

In use, the zipper is opened. An item (or a plurality of items), such as, for example, one or two brassieres, is placed in the enclosure. The zipper is pulled closed by the zipper pull, which is then positioned within the pocket. The enclosure, including its contents, is placed in the washing machine along with the remainder of the load to be washed.

The contents are protected from rough mechanical handling by virtue of being within the enclosure, but are fully washed due to the flow through nature of the mesh. After washing, the contents of the enclosure are removed from the enclosure, and dried in any number of ways well known in the art.

A first aspect of the invention is directed toward an apparatus for washing at least one item, comprising a frame having a dome shape when viewed from its end, specially when filled with items to be washed, and a generally semicircular shape when viewed from its side; and a flow through mesh on the frame which allows washing fluid (generally water) to freely flow to and from the item being washed; the apparatus having an opening through which the at least one item to be washed can be placed into and removed from the apparatus. The frame may have an oval shape when view from its bottom.

In a second aspect, the invention is directed toward an apparatus for washing at least one item, comprising; a frame having an endless pocket; a stiffener disposed within the pocket, the stiffener having a flexible peripheral shape so that flexing of the stiffener provides a pumping action to assist in circulating washing fluid through the apparatus; and a flow through mesh on the frame which allows washing water to freely flow to and from the item being washed; the apparatus having an opening through which the at least one item to be washed can be placed into and removed from the apparatus. The stiffener may have a length exceeding that of the endless pocket, so that ends of the stiffener overlap each other within the endless pocket. The stiffener may be configured so that one end of the stiffener telescopes inside the other end.

The appaxatus may further comprise a closing machanism for closing the opening. The closing mechanism may one of a slide seal arrangement, a fabric fastner or a zipper. If it is a zipper, a pocket for a zipper pull of the zipper may be provided, the pocket being sized, shaped and positioned so that when in the closed position, the zipper pull is hidden, the zipper will remain closed, and the zipper pull will not damage items outside the enclosure.

The invention is also directed to a method for washing at least one brassiere. The method comprises folding the brassiere so that the cups nest; placing the brassiere in an apparatus having mesh panels through which water may flow to wash the item; placing the apparatus in a washing environment; and washing the items in the washing environment. Preferably, the brassiere is placed in the apparatus with the convex portion of the cups facing upward. More than one brassiere, folded into this configuration, may be placed in the apparatus with all the cups successively nesting.

The method may further comprise removing the brassiere from the washing environment and drying the brassiere, by permitting it to dry.

The washing environment may be a washing machine or a disinfecting or sterilizing environment. The brassiere may comprise a prosthetic component. The method may further comprise washing other items of lingerie with the brassiere.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
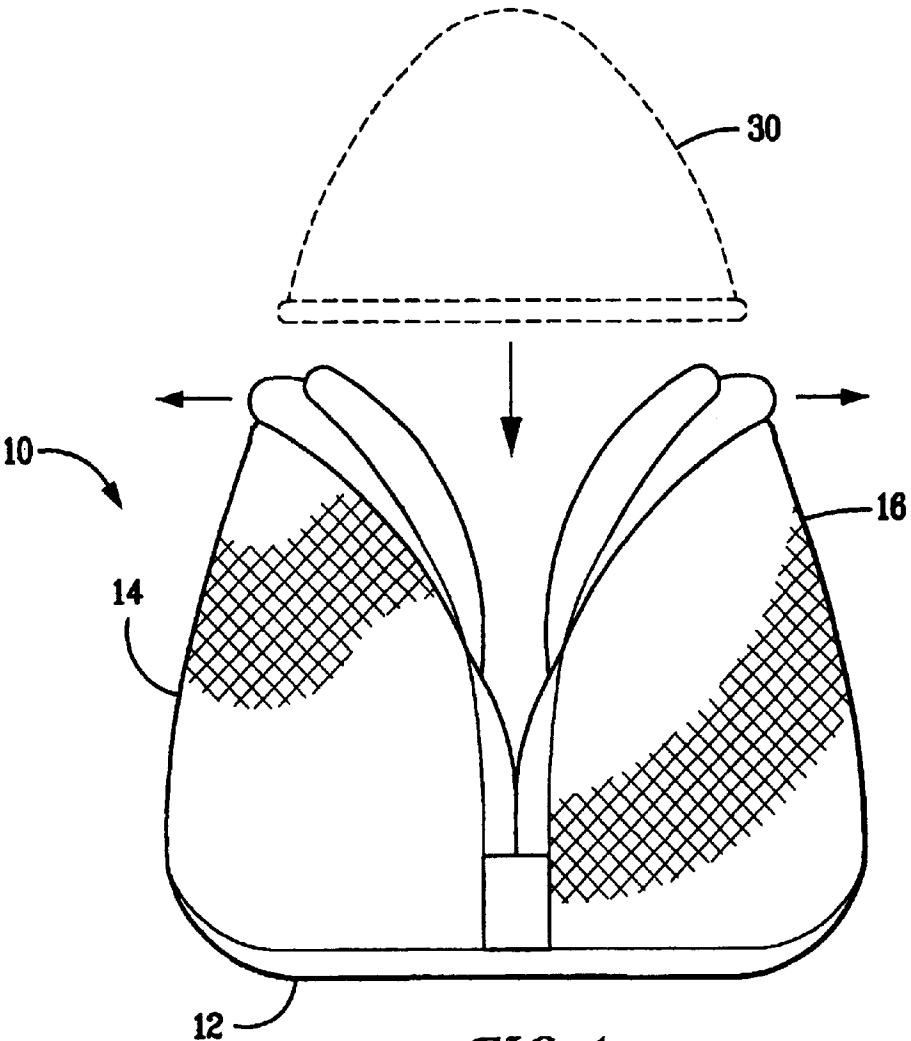
FIG. 1 is a front elevational view of an apparatus in accordance with the invention, opened to receive a folded garment (a brassiere).

Referring to FIG. 1, there is shown a front view of an apparatus 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Referring to all of the Figures, apparatus 10 has an oval shaped bottom panel 12 and side panels 14 and 16. These panels are formed of a fabric mesh material, such as an open weave nylon which is nip rolled under heat and pressure to a polyester mesh having a continuous array of closely spaced opening of about 1.0 millimeter in diameter. The resulting structure allows water used to wash and rinse an item, such as a garment, placed within apparatus 10 to flow freely into and from the interior of apparatus 10. This composite mesh material has a soft texture and is very flexible, thus protecting garments placed within apparatus 10, as well as those external to apparatus 10 which come into contact with the exterior of apparatus 10, during the washing process.

Figure 5:
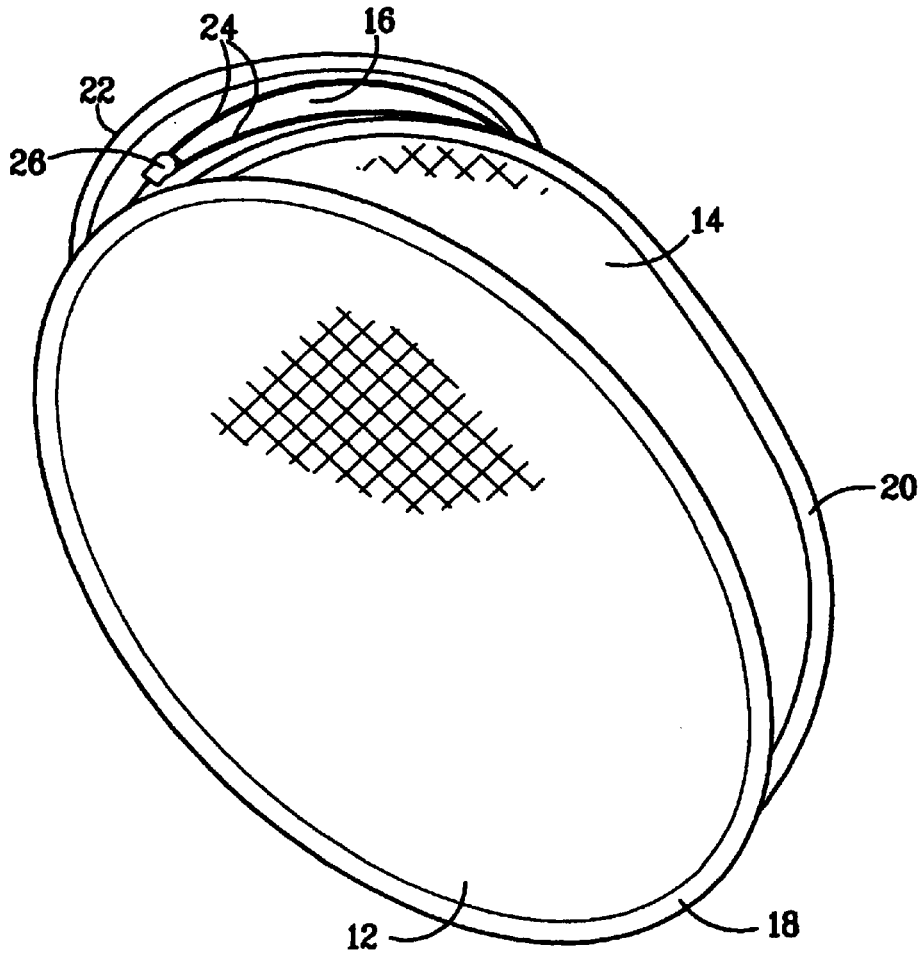
FIG. 5 is a perspective view of the embodiment FIG. 1, turned inside out.
Figure 6A:
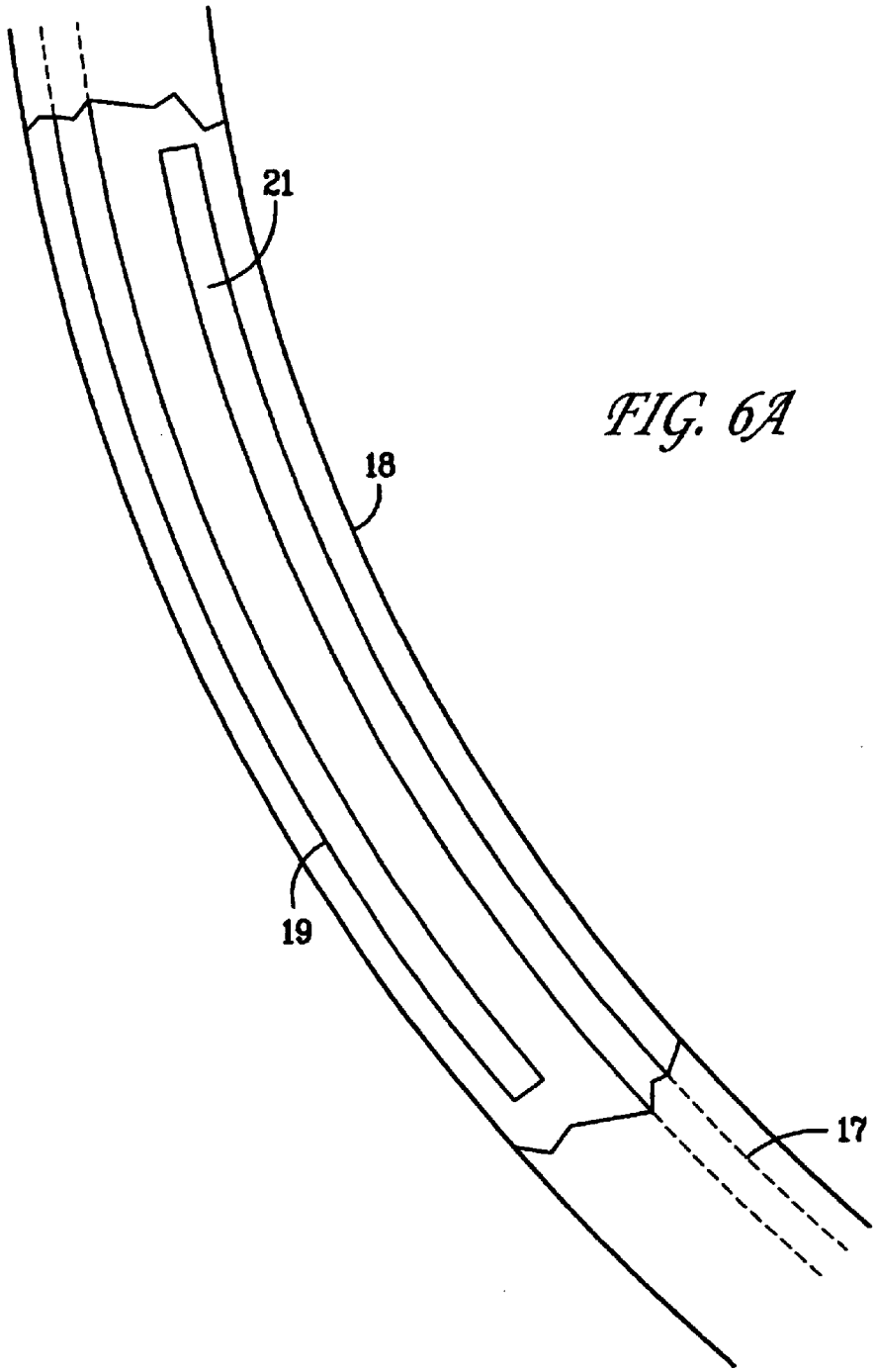
FIG. 6A and FIG. 6B are enlarged, detailed cut-away views of different embodiments of a portion of FIG. 5.

Apparatus 10 holds its shape due to extruded plastic stiffeners formed of a material such as polypropylene, and having a diameter of approximately 1.0 millimeter. A first stiffener 17 (FIG. 5) is disposed within a first endless fabric pocket 18 sewn to bottom panel 12. The stiffener does not have to be formed as an endless loop, and may be longer than the circumference of panel 12 so that there is some overlap of its ends 19 and 21 within pocket 18 (FIG. 6A). Such overlap is extremely desirable in that it provides a flexibility in the structure which prevents the stiffener from breaking due to excessive flexing during the washing process in a washing machine. Further, movement of the ends longitudinally with respect to each other so as to slightly increase and decrease the overlap, helps to provide a gentle squeezing action which is similar to that of hand washing, and serves to help circulate or pump the washing water into, through and out of apparatus 10.

Figure 6B:
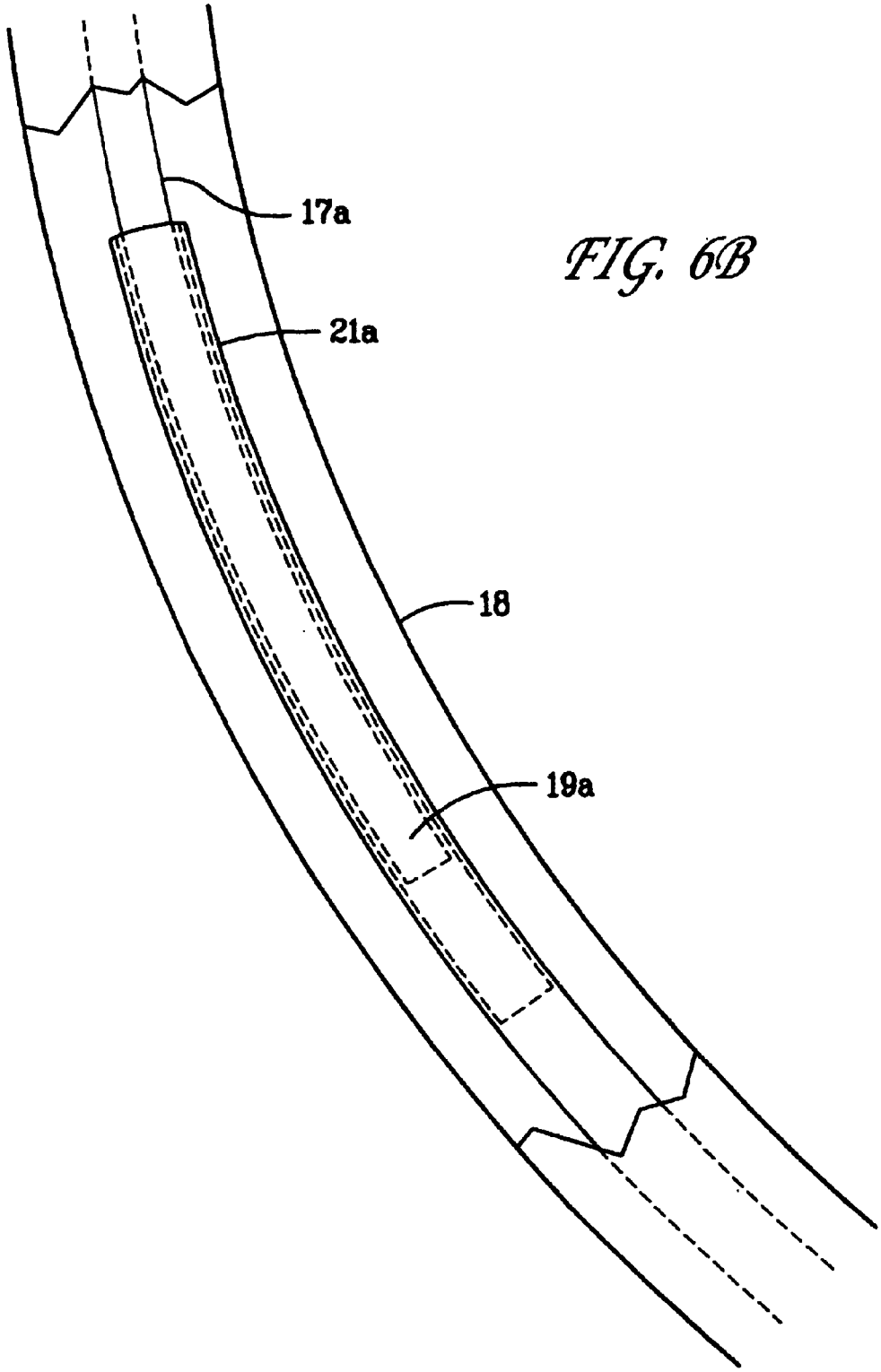

FIG. 6B is similar to FIG. 6A, but illustrates an embodiment wherein a stiffener 17A is configured so that a first end 19A is movably telescoped within a second end 21A of larger diameter than the first end. This arrangement also results in flexibility of the periphery of the oval bottom portion of apparatus 10, thus providing the pumping action of the washing fluid, as discussed above.

Panels 14 and 16, which are generally of semicircular shape, each have a respective pocket 20 and 22 for receiving a respective extruded plastic stiffener. The result, due to the generally oval shape of bottom panel 12 is that the apparatus has a generally dome shape when closed and viewed from its end, and a generally semicircular shape when viewed from its side, when not temporarily deformed during washing, as discussed below. The dome shape is especially evident when the apparatus is filled with at least one item to be washed. When empty of items to be washed, the panels 14 and 16 may collapse somewhat toward one another at the top.

The dome shape is extremely advantageous in that it also serves to help circulate washing water through apparatus 10. When the apparatus is hit from almost any angle during the washing process, by other garments in a load, or by impact with parts of the washing machine in which it is placed, temporary deformations or changes in its shape also serve to assist in circulating or pumping the washing water into, through and out of apparatus 10.

Figure 4:
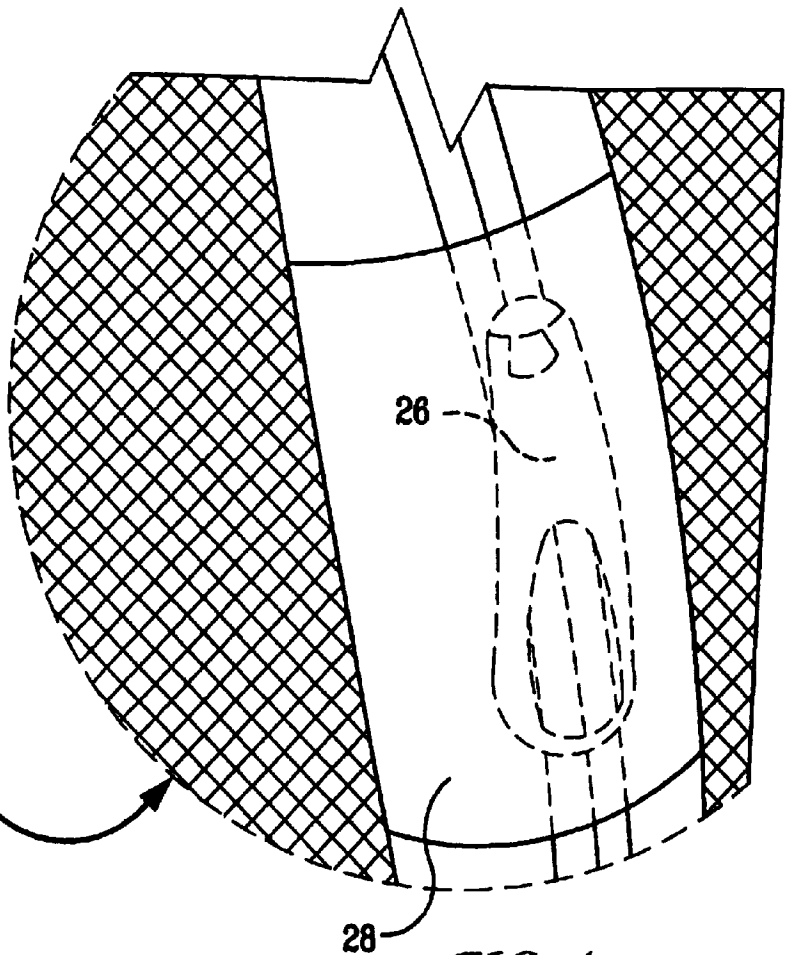
FIG. 4 is a detailed view of a portion of FIG. 3.

A zipper 24, having a zipper pull 26, is sewn to the periphery of panels 14 and 16 where panels 14 d 16 are not connected to panel 12. Zipper 24 is configured with meshing plastic teeth, as is well known in the art. Plastic teeth are used to avoid corrosion of the teeth when they are exposed to water and detergents during the washing process, and zipper pull 26 is preferably made of a plastic material as well. As shown in FIG. 4, an elastic pocket 28 is provided in which zipper pull 26 may be concealed when apparatus 12 is closed and contains a garment to be washed. Other closing arrangements such as a Ziplock® slide seal mechanism or a Velcro® fabric fastener may also be used to releasably secure the opening.

Figure 2:
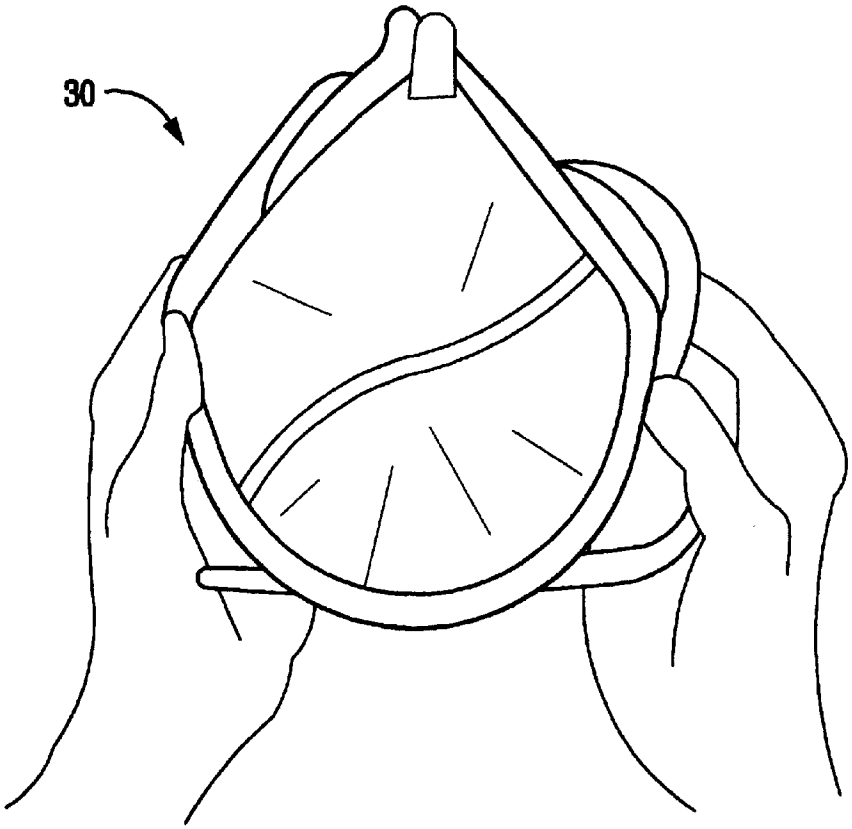
FIG. 2 is a plan view of the manner of folding the brassiere illustrated in FIG. 1.
Figure 3:
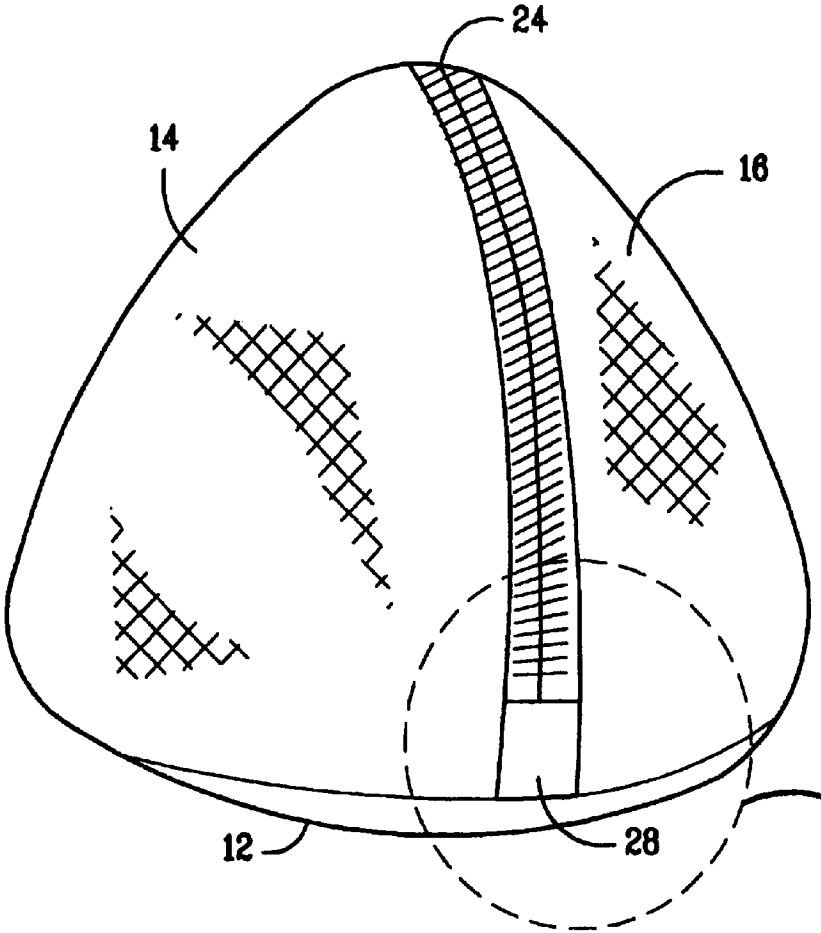
FIG. 3 is a perspective view of the apparatus illustrated in FIG. 1 in its closed configuration.

Referring to FIG. 2, a garment to be washed, such as a bra 30, or other delicate article, that should be gently treated to maintain its shape, is folded before being inserted into apparatus 10. In the case of a bra, the folding may be done so that the cups are aligned one over the other, and in the same direction so that one nests within the other. One or two bras, folded as shown in FIG. 2, may be placed within apparatus 10, by opening zipper 24, and placing the bras therein with the convex part of the cups facing away from bottom panel 12. The zipper is then closed, by pulling the zipper pull 26, as shown in FIG. 3. Zipper pull 26 is then stored within pocket 28, as shown in FIG. 4. Apparatus 10 may then be placed in a clothes washing machine, and the items or garments contained therein will be washed along with other garments in the washing machine that are not contained within apparatus 10.

After the wash cycles have been completed, apparatus 10 is removed from the washing machine. Zipper 24 is opened and the garments contained therein are removed and dried in accordance with drying procedures appropriate for items that have been washed. A dryer may be used, or the items may simply be permitted to dry on their own.

In a preferred embodiment, bottom panel 12 has dimensions of approximately six inches by nine inches, as do panels 14 and 16. While apparatus 10 may be of different dimensions, these dimensions are ideal for an apparatus that receives two bras. The foamy, composite mesh protects the garments, or other items placed therein and assists in maintaining their shape. This is particularly important for brassieres containing prosthetic inserts, as these tend to be expensive and difficult to replace.

It will be understood that while the invention has been described primarily with reference to an apparatus or device for washing delicate items, and in particular items of lingerie, it may have many other uses. For example prosthetic devices of many kinds may be washed and protected, and this may be done in other environments than a washing machine. For example, these additional washing environments may include disinfecting or sterilizing apparatus. Items that can be washed within the apparatus in accordance with the invention may include hair pieces, biological waste containers that must be worn on the body, and a variety of other personal care items that require periodic washing. In addition, the apparatus in accordance with the invention may be used as a container for industrial or other components or parts that may undergo a washing, disinfecting, or sterilizing process. While the washing fluid in a washing machine environment is water, it may be other fluids, such as organic solvents or cleaning fluid.

Thus, it should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An apparatus for washing at least one item, comprising;

a frame;

an endless pocket;

said frame comprising a stiffener disposed within said endless pocket, the stiffener having a length exceeding that of said endless pocket, so that ends of said stiffener overlap each other within said endless pocket, said ends being moveable with respect to each other; and a flow through mesh on the frame which allows washing fluid to freely flow to and from the item being washed;

said apparatus having an opening through which the at least one item to be washed can be placed into and removed from said apparatus.

2. The apparatus claim 1, wherein the frame has an oval shape when view from its bottom.

3. The apparatus claim 1, further comprising a closing apparatus for closing the opening.

4. The apparatus of claim 3, wherein said closing apparatus comprises one of a zipper, a slide seal arrangement, and a fabric fastener.

5. The apparatus of claim 4, wherein said closing apparatus comprises a zipper, further comprising a pocket for a zipper pull of the zipper, the pocket being sized, shaped and positioned so that when in the closed position, the zipper pull is hidden, the zipper will remain closed, and the zipper pull will not damage items outside the enclosure.

6. The apparatus of claim 1, configured to have a dome shape when viewed from its end, and a generally semicircular shape when viewed from its side.

7. The apparatus claim 1, wherein said mesh comprises an open weave nylon; and a polyester mesh having a continuous array of closely spaced openings.

8. The apparatus of claim 7, wherein said polymer mesh openings are substantially 1.0 millimeter in diameter.

9. The apparatus of claim 7, wherein said open weave nylon and said polyester mesh are nip rolled together under heat and pressure.

10. An apparatus for washing at least one item, comprising;

a frame;

an endless pocket;

said frame comprising a stiffener disposed within said pocket, said stiffener having a length exceeding that of the endless pocket, so that ends of the stiffener overlap each other within the endless pocket, said ends being moveable with respect to each other said stiffener having a flexible peripheral shape so that flexing of said stiffener provides a pumping action to assist in circulating washing fluid through said apparatus; and a flow through mesh on the frame which allows the washing fluid to freely flow to and from the item being washed;

said apparatus having an opening through which the at least one item to be washed can be placed into and removed from said apparatus.

11. The apparatus of claim 10, further comprising a closing apparatus for closing the opening.

12. The apparatus of claim 11, wherein said closing apparatus comprises one of a zipper, a slide seal arrangement, and a fabric fastener.

13. The apparatus of claim 12, wherein said closing apparatus comprises a zipper, further comprising a pocket for a zipper pull of the zipper, the pocket being sized, shaped and positioned so that when in the closed position, the zipper pull is hidden, the zipper will remain closed, and the zipper pull will not damage items outside the enclosure.

14. The apparatus of claim 10, wherein the frame has an oval shape when viewed from its bottom.

15. The apparatus claim 10, further comprising a zipper for closing the opening.

16. The apparatus of claim 10, configured to have a dome shape when viewed from its end, and a generally semicircular shape when viewed from its side.

17. The apparatus claim 10, wherein said mesh comprises an open weave nylon; and a polyester mesh having a continuous array of closely spaced openings.

18. The apparatus of claim 17, wherein said polymer mesh openings are substantially 1.0 millimeter in diameter.

19. The apparatus of claim 17, wherein said open weave nylon and said polyester mesh are nip rolled together under heat and pressure.

20. An apparatus for washing at least one item, comprising;

a frame;

an endless pocket;

said frame comprising a stiffener disposed within said endless pocket, the stiffener having a length exceeding that of said endless pocket, said stiffener being configured so that a first end of said stiffener moveably telescopes within a second end of said stiffener; and a flow through mesh on the frame which allows washing fluid to freely flow to and from the item being washed;

said apparatus having an opening through which the at least one item to be washed can be placed into and removed from said apparatus.

21. The apparatus of claim 20, having a dome shape when viewed from its end, and a generally semicircular shape when viewed from its side.

22. The apparatus claim 20, wherein said stiffener has a flexible peripheral shape so that flexing of said stiffener provides a pumping action to assist in circulating washing fluid through said apparatus.

23. The apparatus claim 20, wherein said mesh comprises an open weave nylon; and a polyester mesh having a continuous array of closely spaced openings.

24. The apparatus of claim 23, wherein said polymer mesh openings are substantially 1.0 millimeter in diameter.

25. The apparatus of claim 23, wherein said open weave nylon and said polyester mesh are nip rolled together under heat and pressure.

* * * * *